US005984570A

United States Patent [19]

Parashar

[11] Patent Number: 5,984,570

[45] Date of Patent: Nov. 16, 1999

[54] SELF ENERGIZED AUTOMATIC SURFACE MARKER

[76] Inventor: Amish Parashar, 12822 Martha Ann Dr., Rossmoor, Calif. 90720-4924

[21] Appl. No.: 09/042,200

[22] Filed: Mar. 13, 1998

[51] Int. Cl.[6] ..... G08B 11/00

[52] U.S. Cl. ..... 404/14; 40/565; 362/153.1; 404/16

[58] Field of Search ..... 40/565, 452; 404/12, 404/13, 14, 15, 16; 362/153.1, 470; 345/82

[56] References Cited

U.S. PATENT DOCUMENTS

| | | | |
|---|---|---|---|
| 4,050,834 | 9/1977 | Lee | 404/16 |
| 4,314,198 | 2/1982 | Rogers | 323/351 |
| 4,668,120 | 5/1987 | Roberts | 404/12 |
| 4,753,548 | 6/1988 | Forrer | 404/15 |
| 4,993,868 | 2/1991 | Eigenmann | 404/12 |
| 5,002,424 | 3/1991 | Hedgewick | 404/14 |
| 5,403,115 | 4/1995 | Flader | 404/12 X |
| 5,703,719 | 12/1997 | Chen | 404/16 X |
| 5,816,737 | 10/1998 | Siblik | 404/13 |
| 5,839,816 | 11/1998 | Varga et al. | 362/153.1 |

*Primary Examiner*—Terry Lee Melius
*Assistant Examiner*—Rodrigo J. Morales
*Attorney, Agent, or Firm*—Howard A. Kenyon; Curt Harrington

[57] ABSTRACT

A lane marker of the present invention utilizes a housing and filler to support and protect a solar powered energy storage system. The circuitry draws power from solar cells and stores the energy in 5–20 storage capacitors. When the ambient light dims, the circuitry operates a timing device which causes one or more light emitting diodes located behind an angled clear window, to blink in a direction generally of the approaching traffic. The top of the housing protects a solar cell which is in operating position is mounted above the filler and below a clear upper window. The storage capacity may be varied by increasing or decreasing the capacitance used for energy storage. The duty cycle can be adjusted to levels consistent with sunlight and operating time. Geographic areas of high solar radiation can use the invention set safely have a higher duty cycle without depleting the stored energy, while areas of lower solar radiation can use the inventive circuit set for a lower duty cycle. The marker improves visibility in low light conditions such as curved, banked or mountain roads, is simple, durable and reliable, and eliminates the need for optical guides, lenses and batteries.

1 Claim, 3 Drawing Sheets

SELF ENERGIZED AUTOMATIC SURFACE MARKER

FIELD OF THE INVENTION

The present invention relates to an improved lane marker for independent use on highways and roads which provides automatic capture of the sun's energy during the day and provides a flashing beacon at night, especially useful and advantageous in bad driving conditions of rain or snow.

BACKGROUND OF THE INVENTION

The prior art describes many types and shapes of markers for use on roads and highways which provide a wide array of structures and methods to alert drivers to the existence of defined traffic lanes. Reflective structures are used as reflective paint striping, as well as reflective covering on periodically spaced highway markers. Some markers are vertical plates with reflective surfaces while other more popular structures are raised geometric plates. Raised structures not only provide some vertical or inclined surface from which light can be reflected, but also provide a bumping action against a driver's tires should a driver momentarily stray towards an adjacent lane and onto the divider structures.

A structure which has gained acceptance as a highway marker and divider is a frusto-pyramidal structure wider in the divider than its length, and in which a reflective structure is placed facing the direction of traffic flow. These devices are glued or otherwise attached to the roadway and are filled in with a weighted material for structural integrity and stability. The reflective panels which face the direction of traffic are inclined in order to facilitate over passage by vehicles, as well as to provide reflectivity for a driver relatively closer to the markers.

Reflectivity depends upon the drivers ability to produce a sufficiently strong optical energy beam onto each marker through any barriers such as rain or snow, for the marker to have a sufficiently high reflectivity to redirect reflected optical energy back to the driver through any of the barriers which may be present. The conditions for failure of operation of currently used markers include lack of ability to create and direct the light energy, blockage of the transmission path, inability to reflect, and blockage on the return path. Other factors include ambient lighting, position, color, reflect ability and roadway background.

Failure modes include a driver's headlight failure, extreme snow and rain, and coverage or lack of reflect ability of the markers. Roadway users who have no headlights are at a particular disadvantage, such as bicyclists and the like. Where snow is present, the light from the headlights is quickly attenuated with regard to its forward transmission, and even worse reflected back at the driver, obscuring the ability to see other structures.

The task of providing lighted markers by using conventional power sources is prohibitively expensive. Forming grooves in the roadway to run conduit and wiring is labor, materials and energy intensive. In rural areas, even where such a system is desired, the power may not be available nearby. Other costs and problems involve maintenance, bulb and battery replacement and the like.

What is therefore needed is a system for illuminating the divider between lanes so that drivers can better visually identify the division between lanes in inclement weather, and where the traveler has little or no lighting or very little ability to transmit light energy to structures which are purely reflected. Also needed are markers for other purposes, including marking driveways, swimming pool boundaries, and the like.

SUMMARY OF THE INVENTION

The lane marker of the present invention utilizes a housing and filler to support and protect a solar powered energy storage system. The circuitry draws power from solar cells and stores the energy in 5–10 storage capacitors. When the ambient light dims, the circuitry operates a timing device which causes one or more light emitting diodes to blink.

The light emitting diodes are located behind an angled clear window and aimed generally in the direction of the approaching traffic. A solar cell, in its operating position, is mounted between the potting material and a clear upper window whereby the clear upper window also protects the solar cell. The storage capacity may be varied by increasing or decreasing the capacitance used for energy storage. The duty cycle can be adjusted to levels consistent with sunlight and operating time. In Geographic areas of high solar radiation, a longer duty cycle can be used without depleting the stored energy while in Geographic areas of low solar radiation, a shorter duty cycle must be used without depleting the stored energy. The marker improves visibility in low light conditions such as curved, banked or mountain roads, is durable and reliable, and eliminates the need for optical guides, lenses and batteries.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
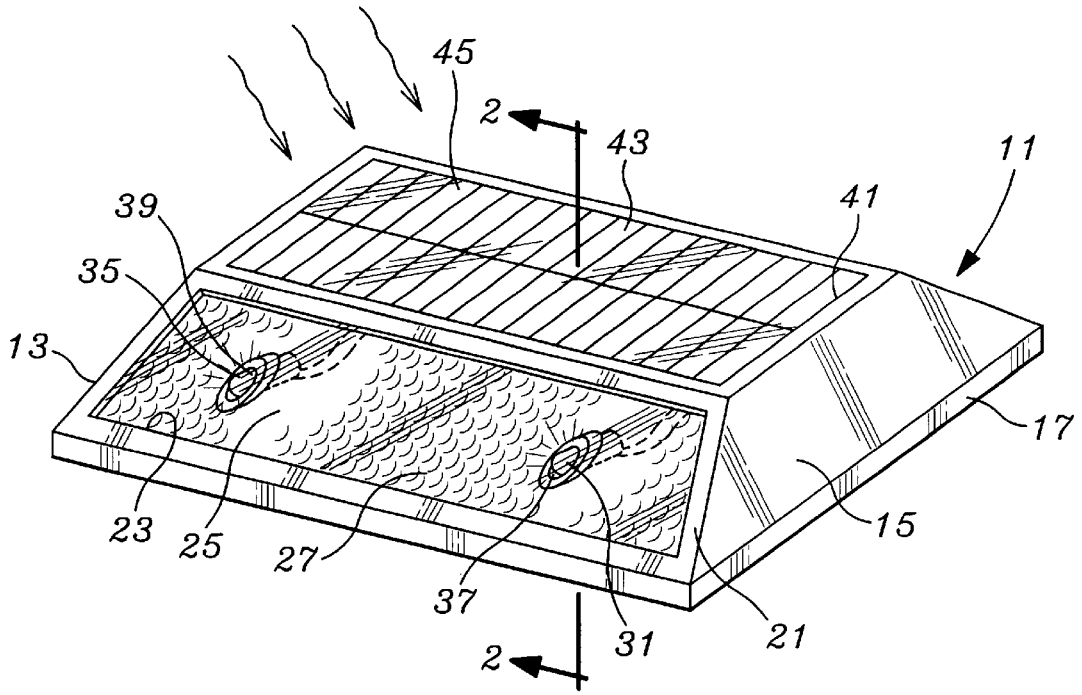
FIG. 1 is a perspective view of the illuminated marker of the invention and illustrating an upper solar cell and a side window with a pair of light emitting diodes.

A description of the inventive marker of the present invention is shown in FIG. 1 as illuminated marker 11. Marker 11 is frusto-pyramidally shaped and has a pair of slanted side surfaces 13 and 15 which terminate at their lower extent by a vertical skirt 17 which extends completely around the marker 11. Marker 11 may also be available in other shapes including round circular, etc.

FIG. 1 best illustrates a first end surface 21 which surrounds a window opening 23. Within the window opening 23 a clear window 25 is located. Behind the window 25 is a reflectorized surface 27 which acts to return and reflect any light directed at the marker 11. The reflectorized surface 27 completely covers the area within the window opening 23 with the exception of the area which is used to project light from light emitting diodes.

A pair of light emitting diodes 31 and 35 are shown protruding from a pair of apertures 37 and 39. The light emitting diodes 31 and 35 are generally horizontal or slightly inclined or placed at an angle to give the most direct alignment with an approaching driver.

Atop the marker 11, a top window opening 41 supports a clear top window 43. Beneath the clear top window 43, a solar cell 45 is located. A view of the opposite end from the same perspective is essentially identical to the view of FIG. 1.

Figure 2:
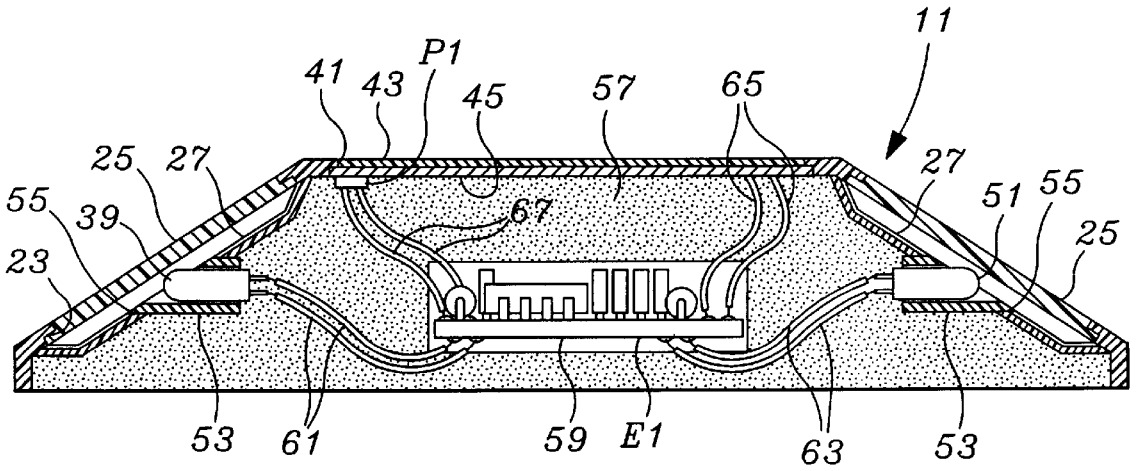
FIG. 2 is a sectional view taken along line 2—2 of FIG. 1 and illustrating the position of a circuit board, light emitting diodes, solar cells and reflector and reflector window.

Referring to FIG. 2, a sectional view taken along line 2—2 of FIG. 1 shows the internals of the marker 11. A light emitting diode 51 is supported by a sleeve 53 to facilitate both the centering of the diode 51 within an aperture 55 in the reflectorized surface 27, and to permit efficient and easy addition of a potting material 57. The sleeve 53 keeps potting material 57 from seeping into a space in front of the light emitting diodes 37 (of FIG. 1), 39, & 51. The potting material 57 is typically any filler material possibly binding with various filler materials. This material 57 provides sufficient weight to stabilize the marker 11 and also fixes the electrical structures within the marker 11 to withstand external forces and the like.

Within the potting material 57 a circuit board 59 is supported. The circuit board 59 may be sealed in plastic or a container especially where the potting material 57 is conductive enough to affect circuitry performance. The nature and orientation of the insulative will depend upon the final electronic circuitry packaging. A small photo switch P1 may be mounted at a portion of said photo cell 45 and connected to circuit board 59 Two light emitting diodes 39 and 51 are seen, as well as the solar cell 45, and all are connected to the circuit board 59 by electric leads 61, 63, 65, and 67, respectively.

Light entering the clear top window 43 supplies solar energy to the solar cell 45 to create electric charge and current to charge capacitors (not individually seen) either on or connected to circuit board 59 for storage during the daylight hours. The device described operates based upon a charge of about three volts. Additional capacitance is expected to be added in parallel, which will add power through provision of additional current capacity at the same low voltage. An envelope E1, shown in almost schematic format represents a close fitting container into which the circuit board 59 is supported in order to isolate the circuitry from invasion from any ionic constituents, moisture or other deleterious components which may be present in the potting material 57.

Figure 3:
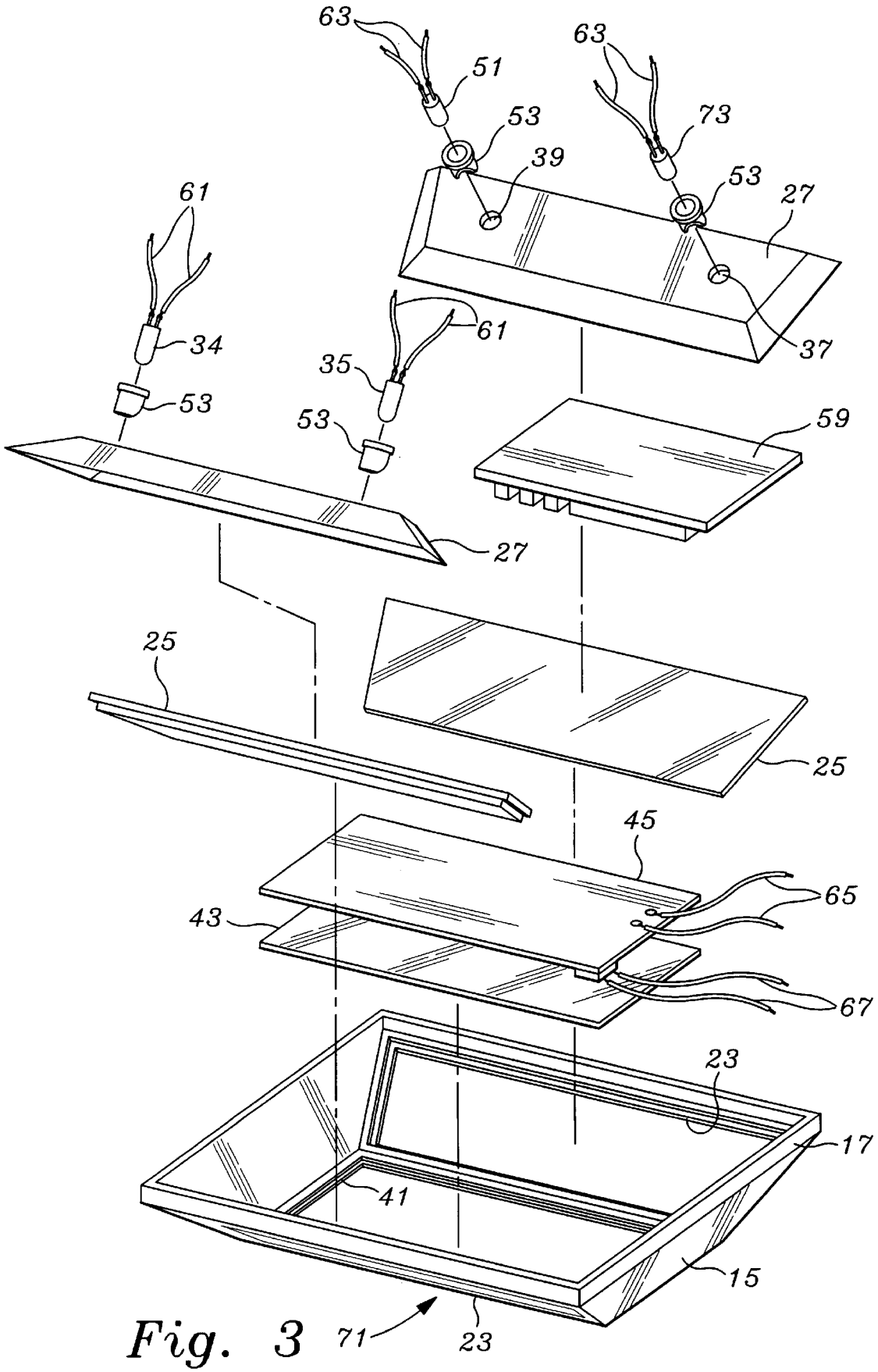
FIG. 3 is an exploded view illustrating the construction of the marker of the invention.

Referring to FIG. 3, an exploded view gives a better idea of the construction of the marker 11. A shell housing 71 provides the base structure to contain the window openings 23, the top window opening 41 and contains the slanted side surfaces 13 and 15 and the vertical skirt 17. The inverted orientation of FIG. 3 is advantageous in explaining the formation of the marker 11. From an inverted position, or by machine in any orientation, the clear top window 43 and the side windows 25 are set in place in their respective top window opening 41 and window opening 23. The small structures needed to lock the clear top window 43 and the side windows 25 in place may be many and varied and employed in combination. For example, locking tabs can be used, or the windows can be simply glued in place. Typically the shell housing 71 may be made of bright yellow plastic or composite material. The use of the clear top window 43 and the side windows 25 is really for the purpose of enabling a shell housing 71 to be pre formed of bright material. Also seen is a fourth light emitting diode 73.

The alternative to this would be to provide a single piece clear plastic shell housing with the clear top window 43 and the side windows 25 structures being already formed, simply by extension of the material. Once the other components are added, the integrally formed top window and side windows could be covered with tape or other barrier material and the integral plastic shell painted with reflective paint and then the barrier material subsequently removed.

After the clear top window 43 and the side windows 25 are in place in the shell housing 71 to form an integral windowed housing, the solar cell 45 is put in place over the clear top window 43 with the light energy absorbing side facing the clear top window 43. Next, reflectorized surface material 27 is placed against each of the side windows 25. The reflectorized surface material 27 should ideally be pre cut with apertures 37 and 39 which correspond to the angle of approach of the sleeves 53. Where the side windows 25 and reflectorized surface material 27 are both angled and the orientation of the light emitting diodes 35, 39, 51 & 73 have an angle not normal to the surfaces of the side windows 25 and reflectorized surface material 27, the apertures 37 and 39 will be oval to match the circular ends of the sleeves 53.

The ends of the sleeves 53 approaching the reflectorized surface material 27 can be glued or adhesively attached to the reflectorized surface material 27. Only enough attachment is necessary to hold the sleeves 53 and light emitting diodes 35, 39, 51 & 73 in place during the addition of the potting material 57. Once the potting material 57 is introduced and sets, the internals of the marker 11 will be essentially permanently fixed.

Although not shown for clarity in FIG. 3, the circuit board 59, light emitting diodes 35, 39, 51 & 73, solar cell or cells 45 will probably be provided as a single connected unit, preferably with the circuit board 59 sealed against the insulated leads 63 and 61. In some cases, the solar cell 45 may be attached to the circuit board 59, and all of the leads 61, 63, and 65 having a pre-specified length so that the marker 11 may be more readily assembled.

Once the electrical components are set into place the potting material 57 may be gently added to the inside of the shell housing 71 and filled to the top, adjacent the vertical skirt 17. The potting material 57 is preferably a sand or silicate with an epoxy filler, but most any potting material 57 can be used, and especially preferred are the potting materials which are not conductive.

Figure 4:
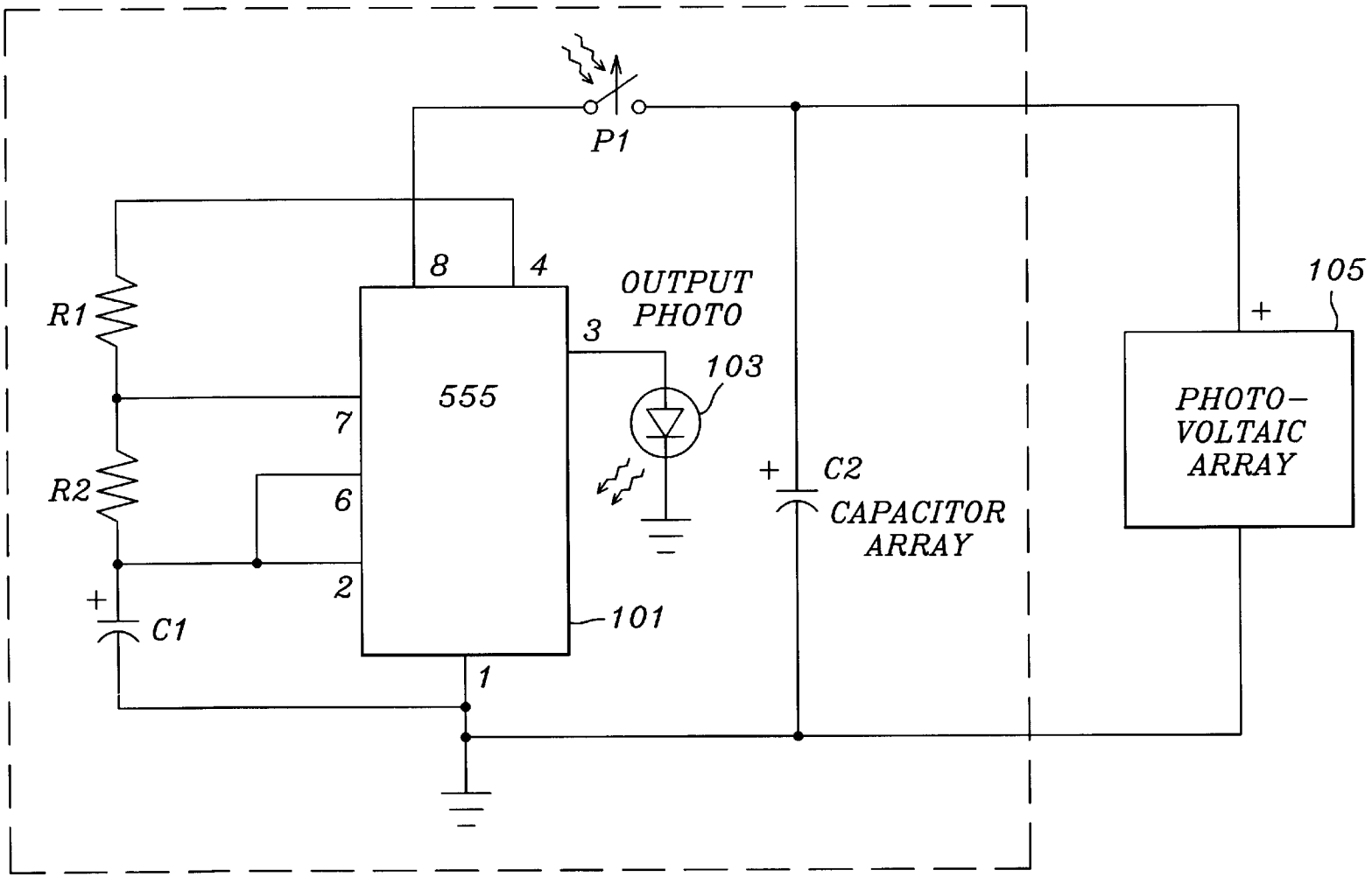
FIG. 4 is a simplified circuit diagram of a simple circuit mechanism for use with the present invention.

Referring to FIG. 4, a circuit schematic is shown which has a timer chip 101 which is generically known as a 555 timer chip. This integrated circuit usually has eight terminals, labeled 1–8 and located adjacent the timer chip 101, and which are used to sense resistances and voltages which in turn will dictate the operation of the timer chip.

Briefly, the schematic of FIG. 4 illustrates a resistor R1 between terminals 4 and 7 of timer chip 101, and a resistor R2 between terminals 7 and connected terminals 6 and 2 of timer chip 101. A capacitor C1 is located between terminal 2 of the timer chip 101 and terminal 1, which is the ground terminal.

Terminal 3 of timer chip 101 is connected to the power input of a general light emitting diode 103. A single general light emitting diode 103 is used to represent the individual light emitting diodes 35, 39, 51, & 73, which are connected in series between terminal 3 and ground, or between terminal 3 and terminal 1.

Terminal 8 of the timer chip 101 receives power through a photo switch P1. When photo switch P1 receives light, as is expected to occur during daylight hours, it opens to shut off power to the timer chip 101, which then prevents the timer chip 101's supplying power to the photo diode 103. When the switch P1 closes, power can be supplied to the chip 101 through a capacitor array C2 which is represented by a single capacitor, but which can in fact be several capacitors connected in parallel. The parallel connection facilitates current storage through charge storage.

Connected in series with the capacitor array C2 is a photo voltaic array 105 which is a series of photo cells arranged to deliver current to the capacitor array C2 at a voltage of about three volts. In the day, when the photo switch P1 is off, the photo voltaic array 105 charges the capacitor array C2. At night, the photo switch P1 closes and supplies electrical power from the capacitor array C2 to the timer chip 101 to operate the light emitting diodes 35, 39, 51, & 73. Under rainy conditions which occur during the day, and once the ambient light is low enough, the timer chip 101 will go into operation. It is expected that the photo switch P1 will have a sufficiently high threshold that the timer chip 101 will probably not operate during periods where any significant light falls on the photo voltaic array 105. Ideally, the photo switch P1 should come on only under the darkest conditions likely to be encountered, in order to conserve charge and thus to conserve the energy capacity of the capacitors.

It is preferred to set the oscillation frequency of the timer chip 101 to have a duty cycle of from about 6% to about 15% with triggering to occur more often than one second. A low duty cycle can be used where the time during which the light emitting diodes 35, 39, 51, & 73, will be on for 0.050 seconds and off for a duration of 0.779 seconds before being turned on again. This corresponds to a duty of 6.03%. A high duty cycle might energize the light emitting diodes 35, 39, 51, & 73, for 0.124 seconds followed by an off time of 0.705 for a 15% duty cycle. A medium duty cycle would be an on time of 0.107 seconds followed by an off time of 0.722 seconds for a duty cycle of about 12%.

A very light duty cycle can trigger the light emitting diodes 35, 39, 51, & 73, for about 0.124 seconds every 0.607 seconds. In this very light duty cycle, the values of the resistors in the circuit of FIG. 4 are R1=120 k ohms, R2=33 k ohms, and capacitor C1=4.7 $\mu$F. With these values in the circuit determining the cycle duty, the only variable left to explore is that of the storage capacitors.

The storage capacitors for the capacitor array C2 which work well and have a good potential for spatial arrangement within the shell housing 71 to evenly distribute their volume is a one Farad capacitor having a rated DC voltage of 5.5 volts. This capacitor is available in a 0.8 inch diameter and with a height of 0.28 inches. It is recommended to use 5 capacitors at least to yield a minimum discharge time of about 3.0 hours, where four light emitting diodes 35, 39, 51, & 73, are used. The capacitance corresponding to evenly computed discharge times for the four light emitting diodes 35, 39, 51, & 73, are given in the table below, and which are based upon the 0.607 second cycle time, although the designer is more likely to be confronted with a choice between even numbers of capacitors used in the capacitor array C2 and the discharge time can be interpolated from the data. This model assumes the use of only two light emitting diodes 35, 39, 51 or 73 and more may be used with slightly less capacity, since much of the energy from the storage capacitor array C2 is used to power the integrated circuit 101.

TABLE 1

Capacitance & Discharge Times for a 0.607 second cycle

| Capacitance (Farads) | Discharge Time |
|---|---|
| 5.00 F | 3.0 hours |
| 6.67 F | 4.0 hours |
| 10.0 F | 6.0 hours |
| 13.5 F | 8.0 hours |
| 20.0 F | 12.0 hours |

The other variable is size of the capacitors compared against charging time, duty cycle and sunlight exposure. If a large number of capacitors are used, the ability of the potting material 57 to adequately support the weight of a vehicle rolling across the marker 11 might be impeded. The method of arrangement of extended capacitance structures can accommodate increased stress, where such capacitors of the capacitor array C2 are high efficiency and distributed so that the potting material 57 will still be able to compressively accept any loads applied to shell housing 71.

While the present invention has been described in terms of a series of roadway lane separation markers, one skilled in the art will realize that the structure and techniques of the present invention can be applied to many similar structures. The present invention may be applied in any situation where limited solar energy is needed to be stored to operate a device at night and then automatically cease operation at dawn and recharge. The invention is especially useful where duty cycle can be varied to take account of variations in expected solar energy input, and where an electrical device can be expected to cycle infinitely without significant failure.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A marker for use on a surface comprising:

a housing having an end window through which visible light may be transmitted, and a top window through which light energy may be received;

a light emitting diode mounted adjacent to said end window for transmitting light through said end window;

a solar cell within said housing and adjacent said top window to receive light energy and produce electrical current and voltage;

a storage capacitor array electrically connected said solar cell to be charged by said solar cell when said solar cell receives light energy;

a timer circuit having an input and an output connected to said light emitting diode to sequentially control a first period of illumination and a second time period when said light emitting diode is not illuminated;

a photo switch connected between said storage capacitor array and said timer circuit to energize said timing circuit during conditions of ambient darkness;

a reflectorized layer adjacent said end window and having an aperture through which visible light may be transmitted by said light emitting diode toward said end window;

a sleeve surrounding said light emitting diode to orient it with respect to said end window;

a potting material within substantially filling a balance of space within said housing;

an enveloping layer surrounding said storage capacitor array and said timer circuit to protect said storage capacitor array and said timer circuit from said potting material.

* * * * *